US005689082A

United States Patent [19]

Youngblood

[11] Patent Number: 5,689,082

[45] Date of Patent: Nov. 18, 1997

[54] ELECTRICAL CONNECTOR SYSTEM FOR AN ACOUSTICAL GUITAR

[76] Inventor: Paul E. Youngblood, 1617 E. Stella St., Fort Worth, Tex. 76104

[21] Appl. No.: 517,094

[22] Filed: Aug. 21, 1995

[51] Int. Cl.[6] ..... G10H 1/32; G10H 3/18

[52] U.S. Cl. ..... 84/743

[58] Field of Search ..... 84/723, 724, 726–728, 84/731, 733–743, 267

[56] References Cited

U.S. PATENT DOCUMENTS

| | | | |
|---|---|---|---|
| 4,519,287 | 5/1985 | Naruse | 84/743 |
| 4,532,847 | 8/1985 | Youngblood | 84/1.16 |
| 4,984,498 | 1/1991 | Fishman | 84/743 X |
| 4,995,293 | 2/1991 | Anderson | 84/743 X |

OTHER PUBLICATIONS

Martin Telemarketing Catalogue, Spring–Summer 1995, pp. 8 and 11.

*Primary Examiner*—Stanley J. Witkowski

*Attorney, Agent, or Firm*—Charles D. Gunter, Jr.

[57] ABSTRACT

An electrical connector system is shown for an acoustical guitar which has been modified to receive an electrical pickup. The connector system includes a female jack portion having an exposed mouth region which protrudes from the button hole opening provided on the body of the guitar. The female jack portion also has a body with an open interior which terminates in a primary contact plate which carries electrical connections for connection with the electrical leads from the pickup. A male jack portion has a shaft which is adapted to be matingly received within the open interior of the female jack portion and carries mating secondary electrical contacts which mate with the electrical contacts of the female jack when the male jack portion of the connector system is inserted within the female jack portion.

10 Claims, 2 Drawing Sheets

ELECTRICAL CONNECTOR SYSTEM FOR AN ACOUSTICAL GUITAR

BACKGROUND OF THE INVENTION

1. Field of the Invention

The present invention relates generally to accessories for controlling the sound characteristics of the sounds produced by an electrically modified acoustical guitar.

2. Description of the Prior Art

Acoustical guitars are known for a rich and mellow sound which some people favor over the sound produced by an electric guitar. In order to increase the volume and overwise influence the sound characteristics of acoustic guitars, however, these guitars are often fitted with an electrical pickup. The electrical pickup is connected by means of an input jack to a standard electrical amplifier of the type used with an electric guitar. This arrangement allows the musician to obtain increased volume and otherwise modify the sound characteristics of the instrument while maintaining the desired acoustic character of the sound produced.

Perhaps the most common method for installing the pickup involves the insertion of a narrow metal or piezoelectric pickup strip between the saddle and bridge of the guitar proximate the point at which the strings terminate at the saddle. The pickup has two electrical leads which are passed within the guitar body to a female jack portion of a standard electrical input jack, sometimes referred to as an endpin jack. The female jack portion extends through the "button hole" opening at the rear of the guitar body which normally retains the strap button for attaching one end of a guitar neck strap. By enlarging the button hole slightly, the female jack portion can protrude from the button hole without the necessity of cutting additional holes in the guitar body. This type of modification to the acoustical guitar is known in the prior art and will be familiar to those in the relevant industry and allows the guitar to be electrically adapted with a minimum of alteration to the guitar body which is often times hand crafted and extremely valuable. Other pickups are known which can be mounted on the bridge plate on the inside of the body of the guitar, but otherwise the described procedure is the same.

The female jack portion of the modified guitar would then be connected to a standard power amplifier by using a connecting cord which was fitted with the male jack portion at either end thereof. One male portion would be inserted within the female jack portion on the guitar and the male jack portion at the opposite end of the electrical cord would be inserted in the female jack portion on the power amplifier. The sound of the guitar could then be controlled by using the electrical controls on the power amplifier.

One disadvantage with this prior art arrangement was that the power amplifier might be located in an inconvenient position for easy access by a performing musician. In my prior issued U.S. Pat. No. 4,532,847, a control accessory is shown for use with a standard acoustical guitar which has been fitted with an electrical pickup and a female input jack of the type described. The control accessory includes a male input jack having a jack case with a male portion extending therefrom which is engagable with the female jack portion of the guitar body. Both a volume and tone control are located on the male input jack for controlling the flow of electricity from the guitar pickup to the remotely located power amplifier to control the sound produced by the guitar.

While the device shown in the '847 patent was an improvement in providing more immediate access to the controls used to affect the sound characteristics of the guitar, the male and female jack portions were standard components which provided only a limited number of electrical leads, usually two leads. As a result, the control accessory shown in the '847 patent was a "passive" accessory which utilized a potentiometer which was electrically wired between the electrical cord and the male input jack so that turning the control knob on the accessory varied the electrical resistance of the control accessory to thereby control the volume and tone of the guitar.

In today's market, a number of "active" controllers are known which typically include a preamp solid state electronic circuit and one or more "sliders" or other controls for varying such sound characteristics of the guitar including, for example, the gain, brilliance, treble, middle and bass ranges. For example, one such commercially available solid state device is the Martin/Fishman SLI IV-Band EQ retrofit device which is commercially available from the C. F. Martin & Company of Nazareth, Pa. One problem with the commercially available systems of this type was the necessity of cutting an opening in the guitar body in which to mount the slider/control unit and in which to mount the necessary electronics. Cutting a hole in the guitar body is always less than desirable and can adversely affect the appearance and sound produced by the instrument.

The present invention has as an object to provide an electrical connector system for an acoustical guitar for connecting the electrical pickup with the controller unit by an active electrical circuit.

Another object of the invention is to provide such an electrical connector system for controlling the sound of an electrically adapted acoustical guitar which is easily accessible to the musician while performing.

Another object of the invention is to provide such a control accessory which can be used with an electrically adapted acoustical guitar which is simple in design and economical to manufacture and which does not involve the necessity of drilling or cutting additional openings in the guitar body or otherwise altering the appearance of the guitar.

Another object of the invention is to provide such a connector system which utilizes the female button hole jack commonly found on electrically modified acoustical guitars.

Another object of the invention is to provide such an electrical connector system which allows the connection of multiple electrical leads between a preamp board located within the interior of the guitar body and an electrical controller mounted on the guitar exterior.

Another object of the invention is to provide an electrically modified acoustical guitar in which the major electrical components, such as the pickup preamp, controller preamp and battery, can be located within the body of the guitar, out of sight of the user or audience.

SUMMARY OF THE INVENTION

The electrical connector system of the invention is intended to be used with an acoustical guitar which has been adapted to receive an electrical pickup. The pickup can be conveniently mounted at the guitar saddle region with the electrical leads from the pickup passing from the electrical pickup to the interior of the guitar. The connector system includes a female jack portion having an exposed mouth region which protrudes from a button hole opening provided on the body of the guitar. The female jack portion also has an elongate body with an open interior which terminates in a primary contact plate having a plurality of electrical contacts for electrical connection with the electrical leads from the pickup. A male jack portion is provided having a shaft which is adapted to be matingly received within the open interior of the female jack portion. The shaft of the male jack portion terminates in a mating secondary contact plate having a plurality of electrical contacts which mate with the electrical contacts of the primary contact plate provided on the female jack member when the male jack portion of the connector system is inserted within the female jack portion.

Preferably, the electrical contacts provided on the female jack portion are provided as a plurality of receptacle openings in the primary connector plate which mate with a plurality of pins provided on the secondary connector plate of the male jack portion.

An active electronics package, such as an electrical preamp board, can be located within the interior of the body of the acoustical guitar and connected between the electrical leads from the pickup and the connector plate contacts of the female jack portion of the connector system. Preferably, the male jack portion of the connector system has mounted thereon a control accessory for electrically controlling one or more of the characteristics of the sound produced by the acoustical guitar and fed through the preamp board such as the volume or gain, tone, brilliance, bass, mid-range and treble of the sound produced.

Additional objects, features and advantages will be apparent in the written description which follows.

DETAILED DESCRIPTION OF THE INVENTION

Figure 1:
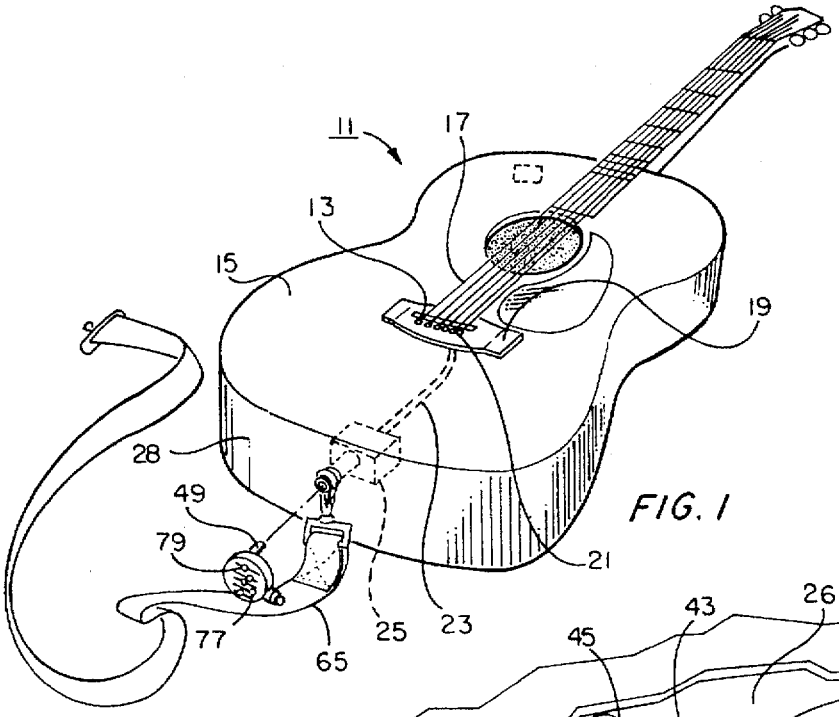
FIG. 1 is a perspective view of an electrically adapted acoustical guitar showing the installation of the electrical connector system of the invention.

FIG. 1 shows an acoustical guitar 11 which has been adapted to receive an electrical connector system of the invention. The guitar 11 has been modified to receive a commercially available electrical pickup 13 which includes a narrow strip of metal or piezoelectric material which is mounted between the saddle and bridge on the front face 15 of the guitar 11 in the saddle region 19 proximate the connecting points 21 where the strings are connected to the saddle. It will be understood for purposes of this disclosure, that the pickup 13 could be mounted in other locations on the guitar body or within the open interior thereof.

The electrical pickup 13 includes two electrical leads (shown in dotted lines at 23 in FIG. 1) which run within the guitar body to an active, solid state electrical means, such as solid state preamp board 25 contained within case 26. The active electronics package contained on the board 25 can assume a variety of configurations, for example, such as the electronics contained within the commercially available Martin/Fishman SLI IV-Band EQ retrofit kit mentioned earlier or the Martin Thinline GoldPlus Preamplification/Acoustic System commercially available from C. F. Martin & Company of Nazareth, Pa. The exact electronics is not critical to the present invention and can vary from simple to complex. In fact, a very simple electrical system, such as that shown in Applicant's issued U.S. Pat. No. 4,532,847, the disclosure of which is hereby incorporated by reference, could be utilized. However, the presence of a solid state electrical circuit board 25 generally dictates that a plurality of output leads 27 (FIG. 2) will be utilized. The particular electronics package illustrated in FIG. 2 has eight output leads.

Figure 2:
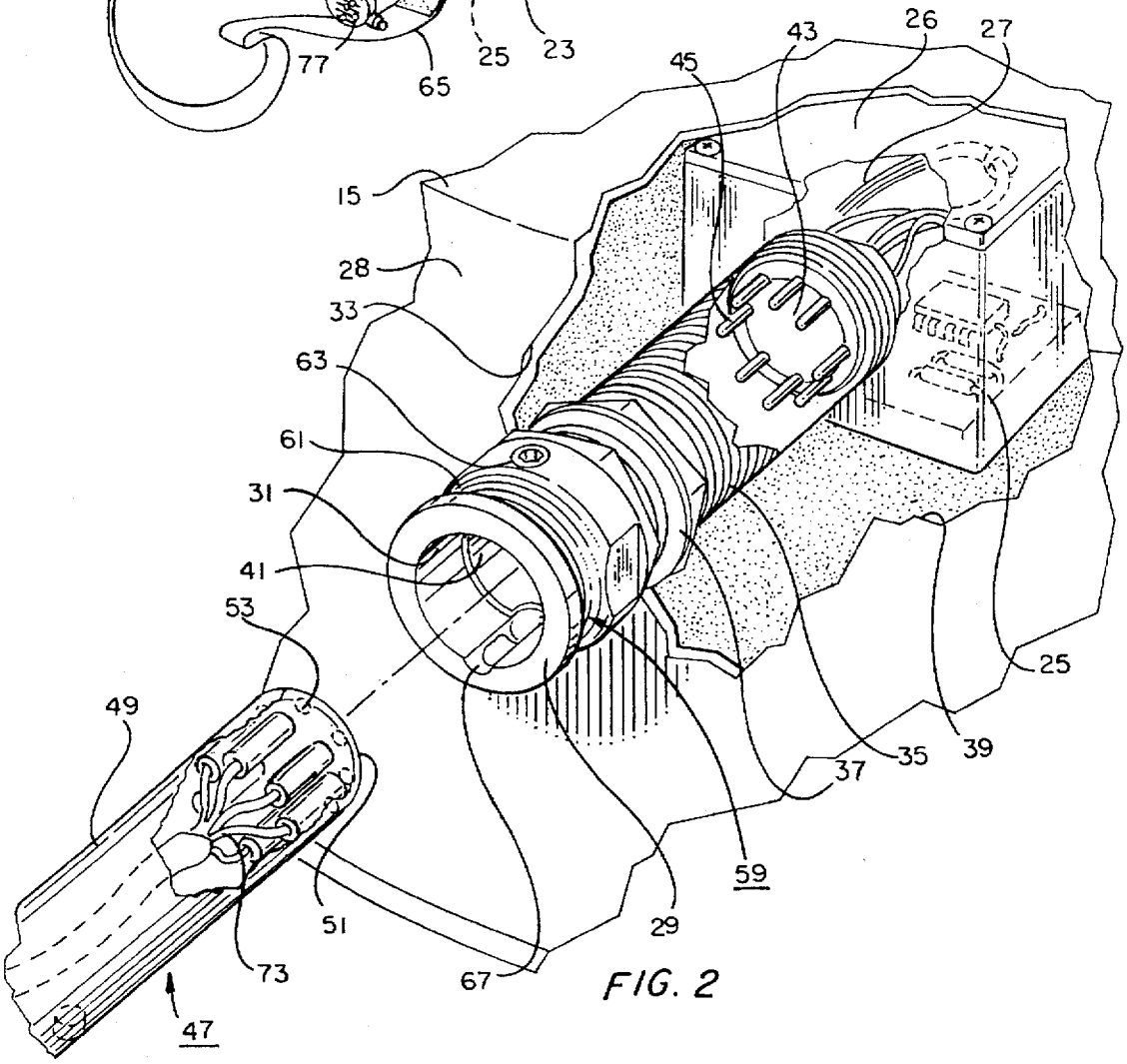
FIG. 2 is a close-up view of a portion of the guitar of FIG. 1 with parts broken away in order to illustrate the electrical connector system with portions of the male and female jack portions thereof being broken away for ease of illustration.

As shown in FIG. 2, the electrical connector system of the invention includes a female jack portion 29 having an exposed mouth region 31 which protrudes from a button hole opening 33 provided on the end region 28 of the body of the guitar 11. The female jack portion 29 includes an elongate, generally cylindrically shaped body 35 which is typically threaded for receiving a mating nut 37, the nut being used to mount the female jack portion within the open interior 39 of the guitar body. The elongate body 35 includes an open interior 41 for receiving a male jack portion. The open interior terminates in a primary contact plate 43 at the end thereof opposite the mouth opening 31. The primary contact plate 43 is provided with a plurality of electrical contacts, such as pins 45 for electrical connection with the electrical leads 27 from the preamp board 25. In the example shown, there are eight such pins located on the primary contact plate 43. However, it will be understood, that a greater or lesser number of pins could be utilized. However, at least three such pins are generally utilized in order to take full advantage of many of the commercially available electronic packages.

A male jack portion 47 is also included as a part of the electrical connector system. The male jack portion 47 includes a shaft 49 which is adapted to be matingly received within the open interior 41 of the female jack portion 29. The shaft 49 is a generally cylindrically shaped, elongate member, the outer diameter of which is sized to be closely received within the diameter of the open interior 41 of the female jack portion 29. The shaft 49 also terminates in a mating secondary contact plate 51 having a plurality of electrical contacts which mate with the electrical contacts 45 of the primary contact plate 43 provided on the female jack portion 29 when the male jack portion 47 of the connector system is inserted within the female jack portion 29. Preferably, the electrical contacts provided on the secondary contact plate 51 comprise a plurality of receptacle openings 53 which receive the pins 45 of the primary contact plate in mating fashion.

Figure 3A:
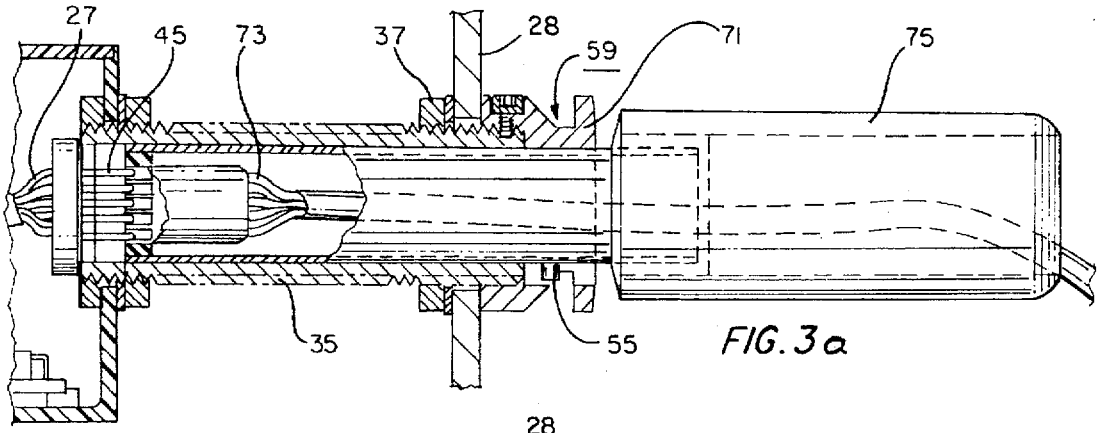
FIG. 3*a* is a side, partial cross-sectional view of one embodiment of the electrical connector system of the invention showing the insertion of the male jack portion into the female jack portion of the connector accessory of the invention.
Figure 3B:
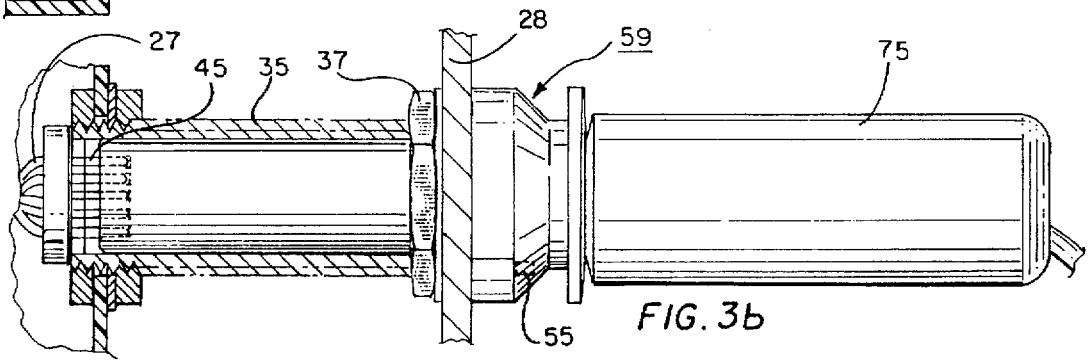
FIG. 3*b* is a view similar to FIG. 3*a* but showing the completed insertion and mating fit between the male and female jack portions of the electrical connector system of the invention.
Figure 5B:
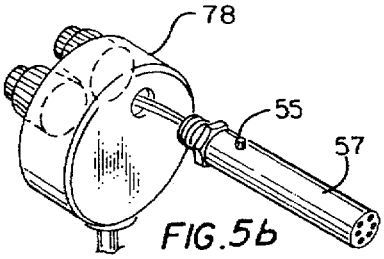
FIG. 5*b* is an exploded view of the male jack portion of FIG. 4 connected to another type of electrical controller.
Figure 4:
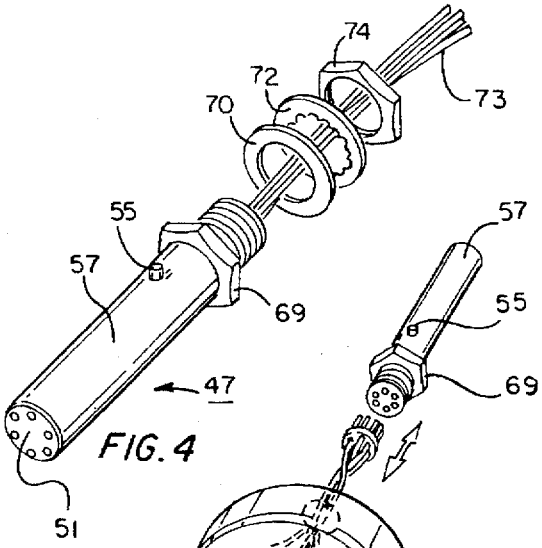
FIG. 4 is an isolated, perspective view of one embodiment of the male jack portion of the invention showing the guide pin and electrical contact plate thereof.
Figure 5C:
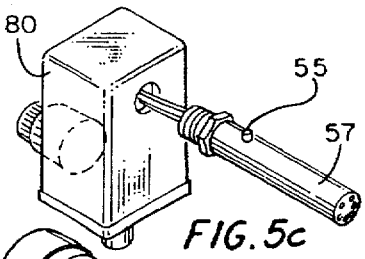
FIG. 5*c* is an exploded view of the male jack portion of FIG. 4 connected to another type of electrical controller.
Figure 5D:
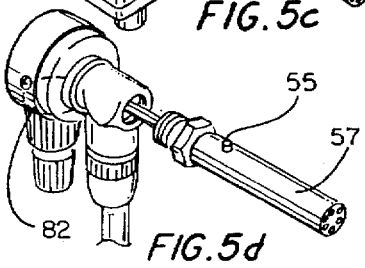
FIG. 5*d* is an exploded view of the male jack portion of FIG. 4 connected to another type of electrical controller.
Figure 5A:
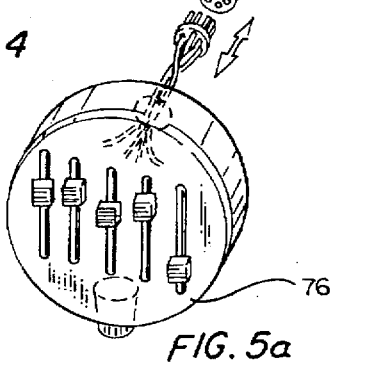
FIG. 5*a* is an exploded view of the male jack portion of FIG. 4 connected to one type of electrical controller.

As shown in FIGS. 3*a*, 3*b* and 4, it is necessary to properly align the pins on the primary contact plate 43 with the receptacle openings 53 provided on the secondary contact plate 51 of the male jack portion 47. This can be accomplished by providing a guide pin 55 located on a selected one of the exterior of the male jack portion (55 in FIG. 4) and the interior 41 of the female jack portion 29. Preferably, the guide pin 55 is located on the exterior 57 of the male jack portion, as shown in FIG. 4.

As shown in FIG. 2, the female jack portion 29 has an external groove 59 defined between a forward shoulder 61 and a rearward shoulder 63. The groove 59 normally receives a portion of a guitar shoulder strap (65 in FIG. 1). As shown in FIG. 2, a guide pin track 67 is located on the female jack portion 29 and passes in a longitudinal direction through the forward shoulder 61 and at least partly through the rearward shoulder 63 when the male jack portion is fully inserted within the female jack portion. FIGS. 3*a* and 3*b* illustrate the guide pin 55 passing along the guide pin track 67 on its way from the exposed position shown in FIG. 3*a* to the recessed position shown in FIG. 3*b*. With the guide pin recessed as shown in FIG. 3*b*, the pin does not interfere with the proper attachment of the guitar strap or its presence in the external groove 59 of the female jack portion 29.

As shown in FIG. 4, the male jack portion 47 can include a stop nut 69 which is threaded received about the exterior thereof and which seats against the outer flange (71 in FIG. 3*b*) of the female jack portion to assist in further locating the male jack portion within the female jack portion. Any of a variety of mating washers 70, 72 and mating nuts 74 may be used to secure the male jack portion 47 to any of a number of commercially available controllers 76, 78, 80, 82 (FIGS. 5*a*–5*d*). A plurality of output leads 73 pass from the male jack portion 47 and can be connected to any desired control accessory for controlling the characteristics of the sound produced by the acoustical guitar. As shown in FIG. 1, the shaft 49 of the male jack portion 47 will typically have the output leads (not shown) connected to a control accessory, such as the slider box 77. The slider box 77 includes a plurality of slider controls 79 for controlling the sound characteristics of the sound being produced by the acoustical guitar. For example, the sliders can be used to control the volume or gain, brilliance, treble, mid-range, and bass of the sound being produced. Any of a variety of commercially available controllers, such as those illustrated in FIGS. 5*a*–5*d*, can be adapted for use with the present invention. It is merely necessary that the electrical output leads 73 of the male jack portion 47 be electrically connected to the electrical controller being utilized. Alternatively, rather than utilizing a controller box, the electrical leads (73 in FIG. 4) could simply be passed out a jack plug top 75 which would pass the multiple electrical leads to a remotely located controller accessory, or directly onto the power amplifier without an intermediate controller.

An invention has been provided with several advantages. The electrical connector system of the invention allows an active, solid state electronic circuit to be mounted within the body of an acoustical guitar with multiple output leads passing through the female jack portion of the system to the male jack portion. Since the male jack portion is received within the mouth opening of the specially modified button hole jack, there is no necessity to cut additional holes or openings or otherwise alter the appearance of the acoustical guitar. The electrical connector system of the invention provides a convenient means for mounting a controller on the electrically adapted acoustical guitar to provide convenient access to the controller during a performance. The power amplifier can be remotely located from the performer while still providing complete control of the sound characteristics to the performer. The connecting accessory is compact in design and simple to manufacture and does not detract in any way from the appearance of the guitar when in place.

While the invention has been shown in only one of its forms, it is not thus limited but is susceptible to various changes and modifications without departing from the spirit thereof.

What is claimed is:

1. An electrical connector system for an acoustical guitar which has been adapted to receive an electrical pickup having an electrical lead which passes from the electrical pickup to the interior of the guitar, the connector system comprising:

a female jack portion having an exposed mouth region which protrudes from a button hole opening provided on the body of the guitar, the female jack portion also having an elongate body with an open interior which terminates in a primary contact plate having a plurality of electrical contacts for electrical connection with the electrical lead from the pickup;

a male jack portion having a shaft which is adapted to be matingly received within the open interior of the female jack portion, the shaft of the male jack portion terminating in a mating secondary contact plate having a plurality of electrical contacts which mate with the electrical contacts of the primary contact plate provided on the female jack member when the male jack portion of the connector system is inserted within the female jack portion;

wherein the electrical contacts provided on a selected one of the primary connector plate and mating secondary connector plate are formed as a plurality of pins adapted to be received within mating receptacle openings provided in the other of the selected primary connector plate and mating secondary connector plate; and wherein a selected one of the primary contact plate and mating secondary contact plate is provided with at least three mating electrical contacts.

2. The electrical connector system of claim 1, further comprising a solid state electronics package located within the interior of the body of the acoustical guitar and connected between the electrical lead from the pickup and the connector plate contacts of the female jack portion of the connector system.

3. The electrical connector system of claim 2, wherein the male jack portion of the connector system has mounted thereon a control accessory for electrically controlling the characteristics of the sound produced by the acoustical guitar.

4. The electrical connector system of claim 3, wherein the control accessory includes both a volume and tone control.

5. The electrical connector system of claim 1, further comprising:

a guide pin located on the exterior of the male jack portion; and a guide pin track formed in the female jack portion for receiving the guide pin and for properly aligning the electrical contacts on the male jack portion with the electrical contacts provided on the female jack portion when the male jack portion is inserted within the open interior of the female jack portion.

6. An electrically modified acoustical guitar of the type having a guitar body with an open interior and an external saddle region, the guitar having an electrical pickup mounted at the guitar saddle region and having an electrical lead which passes from the electrical pickup to the interior of the guitar, the improvement comprising:

an electrical connector system for the electrically modified guitar, the electrical connector system including a female jack portion having an exposed mouth region which protrudes from a button hole opening provided on the body of the guitar, the female jack portion also having an elongate body with an open interior which terminates in a primary contact plate having a plurality of electrical contacts for electrical connection with the electrical lead from the pickup;

a male jack portion having a shaft which is adapted to be matingly received within the open interior of the female jack portion, the shaft of the male jack portion terminating in a mating secondary contact plate having a plurality of electrical contacts which mate with the electrical contacts of the primary contact plate provided on the female jack member when the male jack portion of the connector system is inserted within the female jack portion;

wherein the electrical contacts provided on a selected one of the primary connector plate and mating secondary connector plate are formed as a plurality of pins adapted to be received within mating receptacle openings provided in the other of the primary connector plate and mating secondary connector plate;

wherein the primary contact plate and mating secondary contact plate each are provided with at least three mating electrical contacts;

a guide pin located on a selected one of the exterior of the male jack portion and the interior of the female jack portion; and a guide pin track located on the other of the male jack portion and the female jack portion for receiving the guide pin and for properly aligning the electrical contacts on the male jack portion with the electrical contacts provided on the female jack portion when the male jack portion is inserted within the open interior of the female jack portion.

7. The electrically modified acoustical guitar of claim 6, further comprising an electrical preamp board located within the interior of the body of the acoustical guitar and connected between the electrical lead from the pickup and the primary connector plate contacts of the female jack portion of the connector system.

8. The electrically modified acoustical guitar of claim 7, wherein the male jack portion of the connector system has mounted thereon a control accessory for controlling the characteristics of the sound produced by the acoustical guitar.

9. The electrically modified acoustical guitar of claim 8, wherein the control accessory includes both a volume and tone control.

10. The electrically modified acoustical guitar of claim 9, wherein the female jack portion has an external groove adjacent the mouth opening thereof for receiving a guitar shoulder strap, the external groove being defined between a forward shoulder and a rearward shoulder, and wherein the guide pin track is located on the female jack portion and passes through the forward shoulder and at least partly through the rearward shoulder when the male jack portion is fully inserted within the female jack portion, whereby the guide pin is recessed and does not interfere with the presence of a guitar strap in the external groove of the female jack portion.

* * * * *